US006196324B1

(12) United States Patent
Giacomino et al.

(10) Patent No.: US 6,196,324 B1
(45) Date of Patent: Mar. 6, 2001

(54) CASING DIFFERENTIAL PRESSURE BASED CONTROL METHOD FOR GAS-PRODUCING WELLS

(76) Inventors: Jeff L. Giacomino; Bruce M. Victor, both of 1762 Denver Ave., Fort Lupton, CO (US) 80621

( * ) Notice: Subject to any disclaimer, the term of this patent is extended or adjusted under 35 U.S.C. 154(b) by 0 days.

(21) Appl. No.: 09/290,040

(22) Filed: Apr. 12, 1999

Related U.S. Application Data

(60) Provisional application No. 60/081,351, filed on Apr. 10, 1998.

(51) Int. Cl.[7] ..... E21B 43/12; E21B 44/00

(52) U.S. Cl. ..... 166/372; 166/53; 166/66.6; 166/250.15

(58) Field of Search ..... 166/372, 370, 166/66.6, 65.1, 53, 250.15; 137/624.2, 624.15

(56) References Cited

U.S. PATENT DOCUMENTS

| | | | | |
|---|---|---|---|---|
| 3,863,714 | * | 2/1975 | Watson, Jr. | 166/53 |
| 4,150,721 | * | 4/1979 | Norwood | 166/53 |
| 4,211,279 | | 7/1980 | Isaacks | 166/64 |
| 4,352,376 | * | 10/1982 | Norwood | 137/624.15 |
| 4,410,038 | | 10/1983 | Drapp | 166/53 |
| 4,526,228 | | 7/1985 | Wynn | 166/53 |
| 4,596,516 | | 6/1986 | Scott et al. | 417/58 |
| 4,633,954 | | 1/1987 | Dixon et al. | 166/372 |
| 4,664,602 | * | 5/1987 | Gordon | 417/56 |
| 4,685,522 | | 8/1987 | Dixon et al. | 166/372 |
| 4,916,617 | * | 4/1990 | Norwood | 166/53 X |
| 4,921,048 | | 5/1990 | Crow et al. | 166/372 |
| 4,989,671 | | 2/1991 | Lamp | 166/53 |
| 5,132,904 | * | 7/1992 | Lamp | 166/53 X |
| 5,146,991 | * | 9/1992 | Rogers, Jr. | 166/369 |
| 5,253,713 | | 10/1993 | Gregg et al. | 166/372 |
| 5,407,010 | * | 4/1995 | Hershberger | 166/372 |
| 5,636,693 | * | 6/1997 | Elmer | 166/370 |
| 5,752,570 | | 5/1998 | Shaposhnikov et al. | 166/372 |
| 5,785,123 | | 7/1998 | Lea, Jr. | 166/369 |
| 5,957,200 | * | 9/1999 | Majek et al. | 166/250.15 |

* cited by examiner

*Primary Examiner*—Hoang Dang
(74) *Attorney, Agent, or Firm*—Flanagan & Flanagan; John R. Flanagan; John K. Flanagan

(57) ABSTRACT

A casing differential pressure based control method used in conjunction with a gas-producing well includes the steps of sensing current sales line pressure and well casing and tubing pressures and changing or switching an A valve between open and close states based on differences between selected pairs of these current pressures relative to preset minimum differentials between the same pairs of these pressures. Open Differential Pressure determines when to open the A valve and initiate gas sales. Open Differential Pressure is the preset minimum pressure difference by which the casing pressure exceeds the sales line pressure. Close Pressure determines when to close the A valve and terminate gas sales. Close Pressure is the preset minimum pressure of the casing. Once Open Differential Pressure has been reached and the A valve switched to the open state such that gas sales are occurring, the gas sales are allowed to continue as long as the current casing pressure is dropping and until the current casing pressure reverses. When the current casing pressure reverses and rises by the Close Pressure, the A valve is switched to the close state.

12 Claims, 15 Drawing Sheets

(FIG. 6)

CASING DIFFERENTIAL PRESSURE BASED CONTROL METHOD FOR GAS-PRODUCING WELLS

This application claims the benefit of U.S. provisional application No. 60/081,351, filed Apr. 10, 1998.

BACKGROUND OF THE INVENTION

1. Field of the Invention

The present invention generally relates to plunger lift technology and, more particular, is concerned with a casing differential pressure based control method for gas-producing wells.

2. Description of the Prior Art

In a typical plunger lift system, such as seen in FIG. 1, a gas-producing well W employs a freely movable plunger P disposed within a tubing T in the well that is capable of traveling vertically in the tubing T as the well W is cycled between shut-in and open conditions. The well W is shut-in for an interval during which the pressure of gas G gradually elevates within the well casing C. When the pressure of gas G reaches a desired level, a master gas flow control valve A, commonly referred to in the industry as the A valve, is opened causing the plunger P to be propelled by the accumulated gas pressure from a lower initial position, at a bottom bumper B, upward in the tubing T toward an upper terminal position adjacent to a plunger arrival sensor S at the wellhead. Fluid and gas above the plunger P in the tubing T discharges from the wellhead through a horizontal conduit H into a flow line L, called a gas sales line, leading to a separator (not shown). At the separator, gas and water separate from one another and are routed to separate storage vessels. The plunger P is held at the upper terminal position until the gas pressure diminishes to an extent permitting the plunger P to fall under gravity to its lower initial position.

Many plunger lift systems, in addition to the master flow control or A valve, will typically utilize a second flow control valve, commonly referred to in the industry as the B valve (FIG. 2), with an electronic controller E to control cycling of the well between shut-in and open times and thereby the production of gas from the well. As mentioned above, the A valve is interposed in the gas sales line L whereas the B valve is interposed in a vent line (not shown) that leads to a containment tank or pit or sometimes directly to atmosphere. The gas sales line L is under a higher pressure than the vent line. The shut-in and open times of the cycles providing optimum well production will vary from well to well due to the differing conditions of the wells.

The electronic controller E is programmed by an operator to set close, open, delay and shut-in times for the A and B valves so as to control the times of opening and closing of the A and B valves as well as other functions to provide for desired production and sales of gas from a given well. Also, the plunger lift system typically employs the arrival sensor S at the wellhead to sense the arrival of the plunger P at the upper terminal position. The arrival sensor S sends an electrical signal to the controller E in response to the arrival of the plunger P.

The employment of the B valve is necessary on many wells due to pressure fluctuations experienced in the high pressure gas sales line L of such wells which can impede efficient production of gas from the well W. There are various causes of pressure variation, the main ones being conditions created by mechanical equipment attached to the gas sales line L or the weather. When gas sales line pressure fluctuates enough that it becomes too great for the well casing pressure to exceed it and drive the plunger P to the upper terminal position of the wellhead, the plunger P may stall before reaching the surface or not arrive at the upper terminal position within the preset open time of the A valve. The controller E is programmed to then close the A valve and open the B valve to vent the well casing C to atmosphere or a low pressure tank or pit and thereby permit the plunger P to reach the upper terminal position and blow out the fluid that has accumulated above the plunger P. After the plunger P arrives and blows out the fluid, the controller E will shut the B valve and open the A valve and thus commence sale of gas from the well W through the A valve and the gas sales line L.

The key to efficient gas production is to prevent a head of fluid from building in the tubing T above the plunger P that will exceed the gas pressure in the casing C and prevent lifting the plunger P and fluid to the wellhead. To keep the well casing C and tubing T relatively free of fluid, the plunger P must be cycled at a rate generally matched to the rate that fluid comes into the well casing C from the production formation through perforations in the casing D so as to allow gas to come into the well casing C through the same perforations. The function times programmed in the electronic controller E by the operator are selected based on the particular condition of the well. As the well ages there is typically less gas pressure and more fluid flowing into the well casing C. An operator, therefore, needs to periodically monitor the operation of the well and change the programmed function times as the condition of the well changes.

Electronic controllers have been devised in the past to relieve an operator of this task by automatically counting the number and times of past plunger trip times, comparing them with target numbers and times and changing the programmed times using an algorithm stored in the memory of the electronic controller. While automatic controllers have accomplished this task in a generally satisfactory manner, still they are complicated and expensive and generally fail to optimize the A valve open time when gas produced by a well is being sold. Typically, these controllers will be programmed to close the A valve and terminate gas sales much earlier than needed resulting in a substantial reduction in the level of sales.

Consequently, a need exists for improvement of control of A valve open time to improve the cycling of a gas-producing well between shut-in and open times and thereby improve the efficiency of gas production and sales from the well.

SUMMARY OF THE INVENTION

The present invention provides a casing differential pressure based control method for gas-producing wells designed to satisfy the aforementioned need. The casing differential pressure based control method of the present invention involves monitoring the sales line pressure, casing pressure and tubing pressure and changing or switching between opening and closing the A and B valves based on these pressures relative to preset minimum differentials between selected pairs of these pressures.

As known heretofore, an Open Differential Pressure is used to determine when to open the A valve. The Open Differential Pressure is a preset minimum pressure difference by which the casing pressure needs to exceed the sales line pressure for opening of the A valve to occur. The major improvement fostered by the present invention, however, is a more precise way to determine when to close the A valve and terminate sales so that sales will be allowed to continue for as long as possible with each trip of the plunger. Basically, due to the present invention once sales are occurring they are allowed to continue as long as the current casing pressure is dropping and until the casing pressure reverses. When the current casing pressure reverses and rises by a preset minimum pressure, the A valve is then switched to close state. This preset minimum pressure used to determine when to close the A valve is termed the Close Pressure.

Thus, the approach of the present invention delays closing the A valve so that gas sales will continue as long as the current casing pressure has not decreased to the minimum pressure which is the level when the casing pressure reverses and starts to rise again. After the A valve is closed, the plunger is allowed to drop to the lower initial position. Thereafter, the controller monitors the various current pressures for determining when Open Differential Pressure is reached again to cause the A valve to switch to open state and initiate gas sales.

Accordingly, the present invention is directed to a casing differential pressure based control method used in conjunction with a gas-producing well, a casing within the well for receiving a flow of gas under pressure from a production formation, a tubing extending downward within the casing to a lower portion being in communication with the casing for receiving the flow of gas under pressure therefrom, a sales line located outside of the well and connected in flow communication with the tubing for routing the flow of gas under pressure away from the well, an A valve interposed in the sales line and being convertable between open and close states in which flow of gas is correspondingly allowed and blocked from the tubing to the sales line, and an electronic controller connected to the A valve for controlling the cycling of the A valve between open and close states and thereby the well between the open and shut-in conditions in which the gas under pressure flows correspondingly from the tubing and elevates in pressure in the casing.

The casing differential pressure based control method comprises the steps of: (a) sensing the current casing pressure, current tubing pressure and current sales line pressures; (b) switching the A valve to open state such that gas sales are initiated in response to sensing when the current casing pressure exceeds the current sales line pressure; and (c) switching the A valve to close state such that gas sales are terminated in response to sensing when the current casing pressure has decreased, reversed and then risen by a preset minimum pressure. More particularly, the control method also comprises presetting an Open Differential Pressure equal to a preset minimum pressure difference by which the casing pressure exceeds the sales line pressure, and calculating the difference between the current casing pressure and current sales line pressure. The switching of the A valve to open state is in response to sensing when the difference between the current casing pressure and current sales line pressure reaches the preset Open Differential Pressure. The control method further comprises presetting a Close Pressure equal to a preset minimum pressure of the casing, and sensing when the preset minimum pressure of the casing has been reached. The switching of the A valve to close state is in response to sensing when the current casing pressure has decreased, reversed and then risen by the preset Close Pressure.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
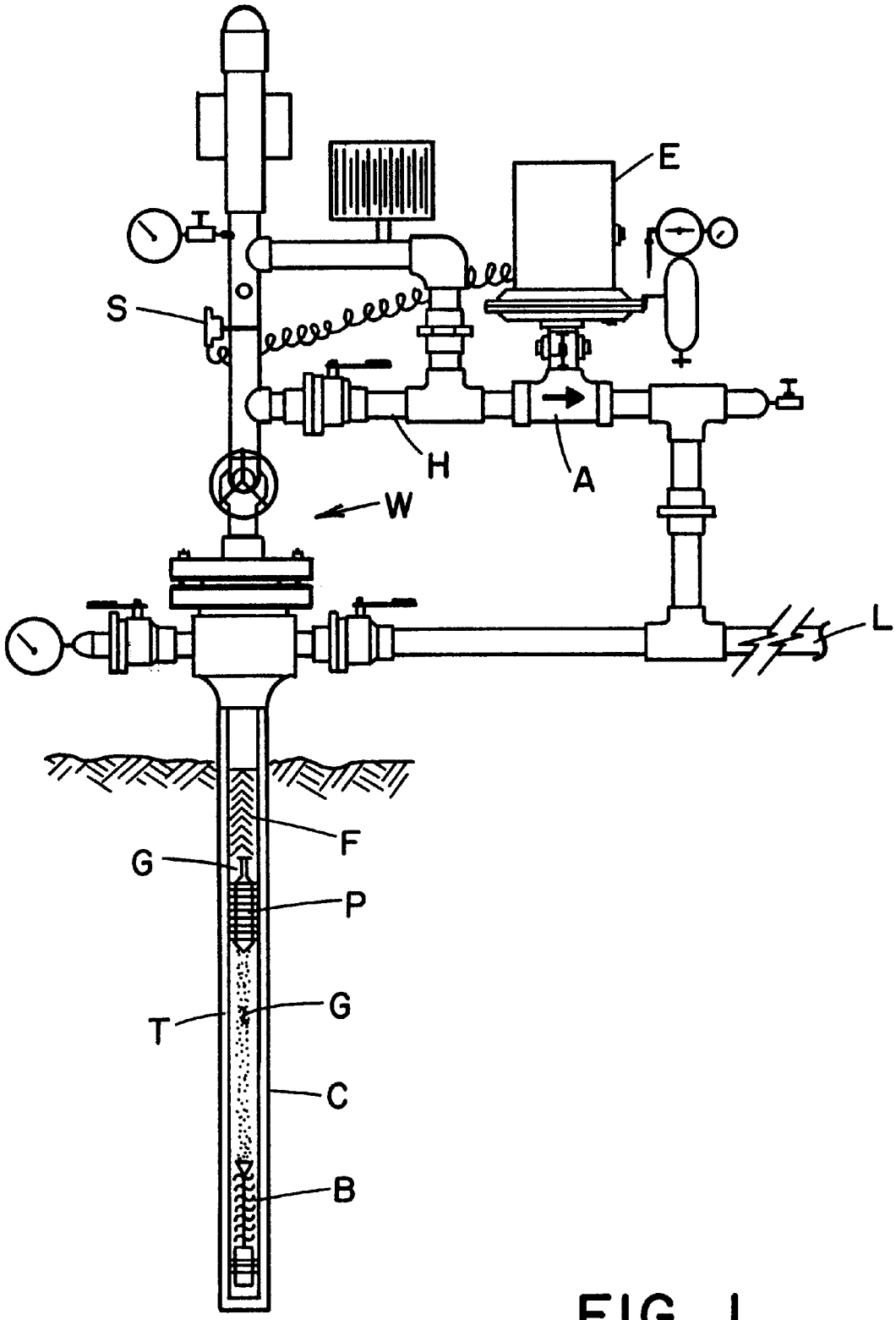
FIG. 1 (PRIOR ART)
FIG. 1 is a diagrammatic view of a prior art plunger lift system which can employ the casing differential pressure based control method of the present invention.
Figure 2:
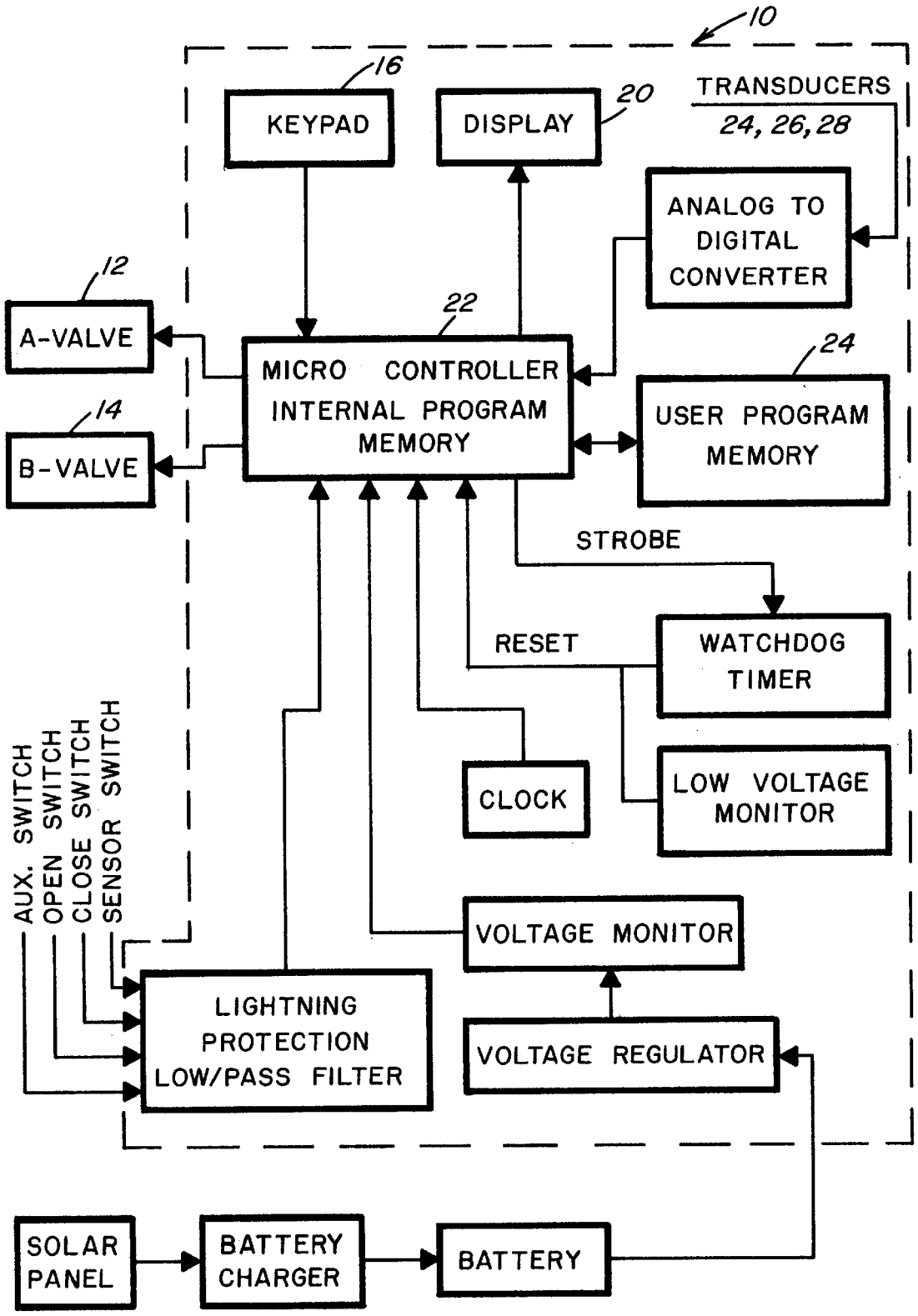
FIG. 2 is a block diagram of an electronic controller programmed to operate in accordance with the method of the present invention.
Figure 3:
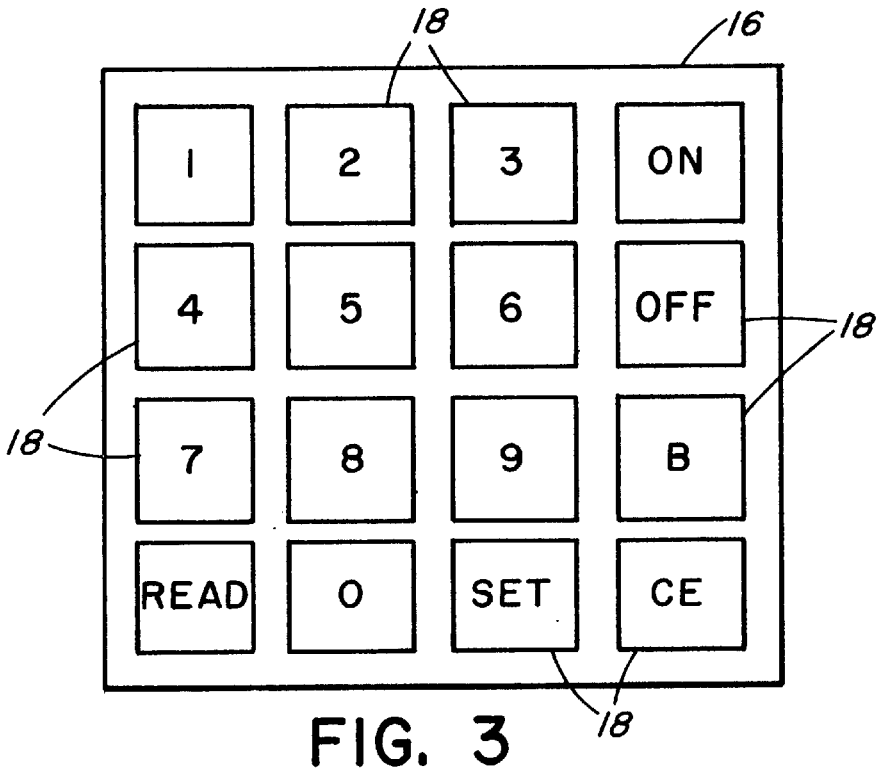
FIG. 3 is a plan diagram of a keypad on the controller of FIG. 2.
Figure 4A:
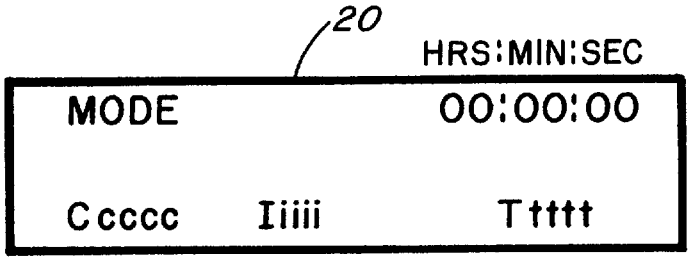
FIGS. 4A and 4B are plan diagrams of two different states of a display on the controller of FIG. 2.
Figure 4B:
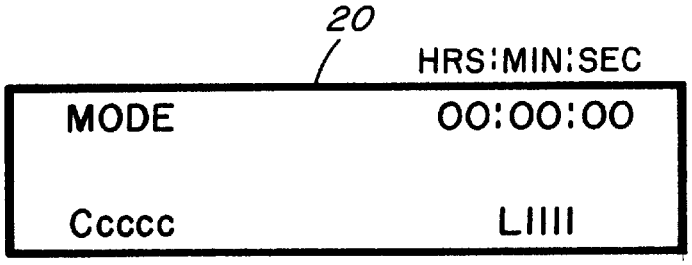

Referring to the drawings and particularly to FIG. 2, there is illustrated in block diagram form the components of an electronic controller 10 for practicing the casing differential pressure based control method of the present invention. The electronic controller 10 is connected to A and B valves 12, 14 and casing, sales line and tubing pressure-sensing transducers 24, 26, 28. The electronic controller 10 is programmed to operate in accordance with the casing differential pressure based control method of the present invention to control open, or flow, close and shut-in times of the well W so as to maximumize the efficiency of gas production from the well. FIG. 3 depicts a keypad 16 on the controller 10 of FIG. 2 having sixteen keyswitches 18 that are assigned numbers 0, 1, 2, 3, 4, 5, 6, 7, 8 and 9 and parameters ON, OFF, READ, SET, CE and B. FIGS. 4A and 4B depict two different states of a display 20 provided on the controller 10.

The controller 10 includes a micro controller 22 interfaced with the A and B valves 12, 14, the keypad 16, the display 20 and the casing, sales line and tubing pressure-sensing transducers 24, 26, 28. The micro controller 22 has an internal program memory for receiving and executing instructions and outputting commands and values, and an external user program memory 30, such as a ROM or PROM, is interfaced with the micro controller 22. A software program which functions in accordance with the present invention resides in the external user memory 30 that is executed by the micro controller 22 in accordance with instructions and values inputted or programmed into the internal program memory of the micro controller 22 by an operator using the keypad 16 for efficiently operating the well to achieve maximized gas production.

FIG. 4A shows the state of the display 20 during normal operation the controller 10 when all three pressure transducers 24, 26, 28 are active. "MODE" represents the current program mode of the controller, "00:00:00" in the time left in the current mode, "Ccccc" is a reading of casing pressure from the casing pressure transducer 24, "Illl" is a reading of sales line pressure from the sales line transducer 26, and "Ttttt" is a reading of tubing pressure from the tubing transducer 28. FIG. 4B shows the state of the display 20 when the tubing transducer 28 has been deactivated. The different controller program MODEs are CLOSE, A OPEN, B OPEN, A DELAY, B DELAY, MANDATORY SHUT-IN, OPEN DELAY and CLOSE DELAY.

FIGS. 5 to 16 together depict a flow diagram representing the steps of the software program run by the electronic controller 10. The program includes the steps performed during the various program modes set forth above.

Figure 5:
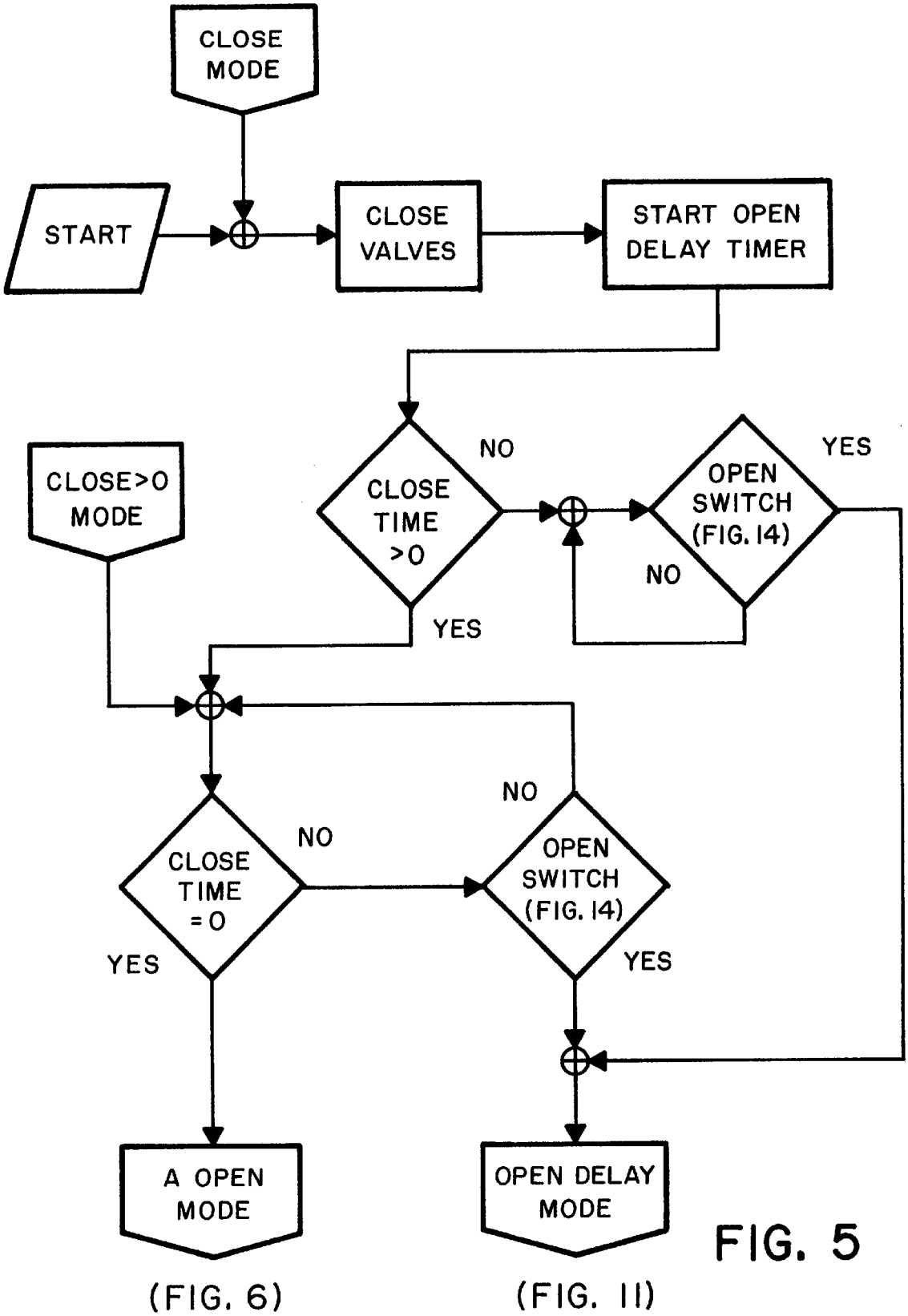
FIGS. 5 to 16 taken together are a flow diagram representing the steps of a software program run by the electronic controller of FIG. 2 which includes the steps performed in carrying out the method of the invention.
Figure 6:
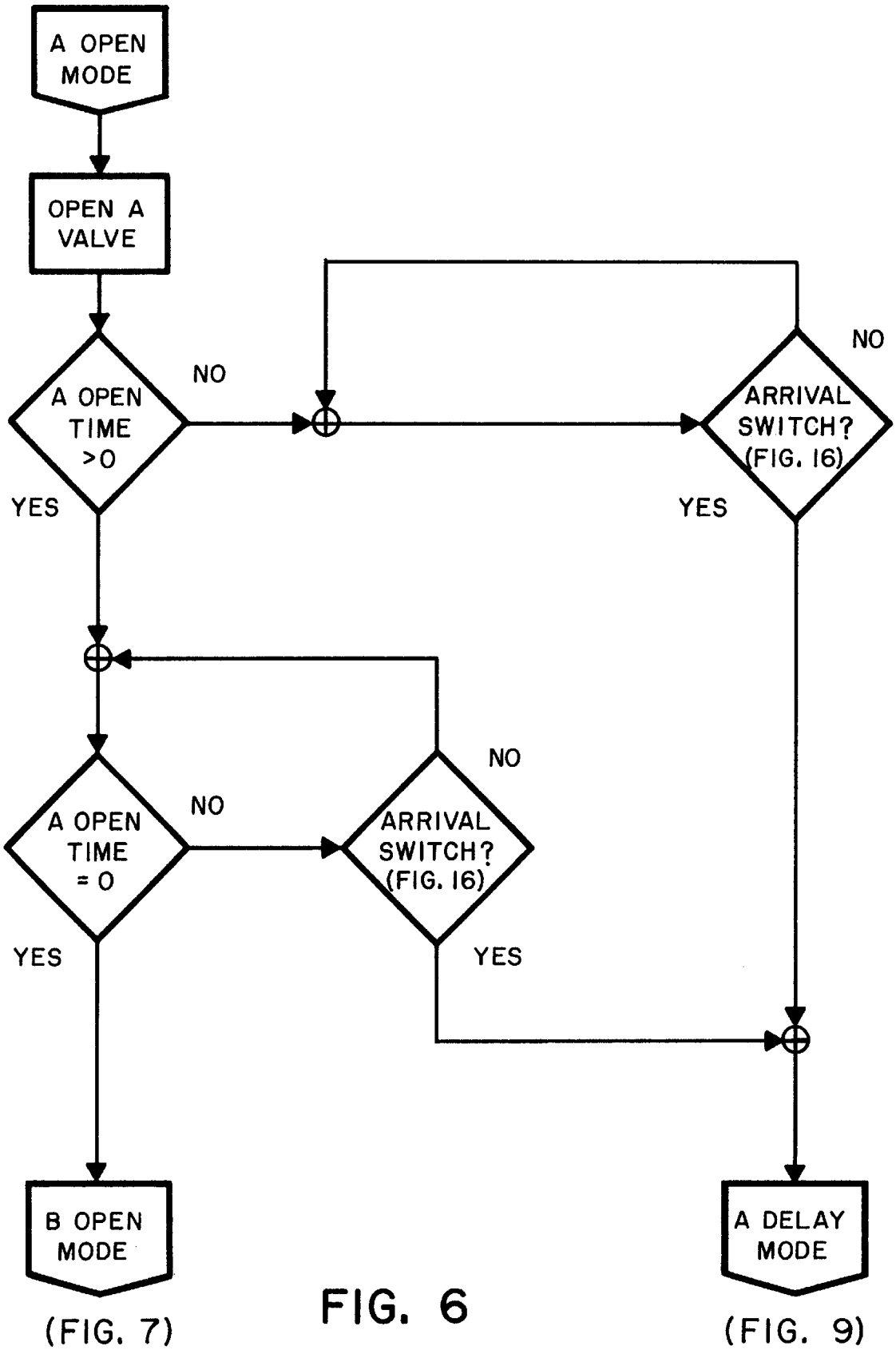

FIG. 5 depicts the CLOSE mode of the controller program in which the Close Time programmed for the A valve is monitored and once the Close Time expires, that is, equals zero, the program goes to the A OPEN mode (FIG. 6). The A Delay timer also must have expired to ensure that the plunger will have time to fall to the lower starting position in the tubing before the A OPEN mode is initiated. The controller program will temporary switch to the OPEN DELAY mode of FIG. 11 before going to the A OPEN mode.

FIG. 6 depicts the A OPEN mode of the controller program in which the A valve is switched from close to open condition and the program loops and awaits the arrival of the plunger to the "up" or upper terminal position in the wellhead. If the plunger is sensed by the arrival sensor as being "up" before A Open Time expires or equals zero, then the program goes to the A DELAY mode of FIG. 9. If the plunger is not sensed as being "up" when A Open Time expires or equals zero, then the program goes to the B OPEN mode of FIG. 7. (The A and B Open Times are initially set at various values to accommodate different well conditions.)

Figure 7:
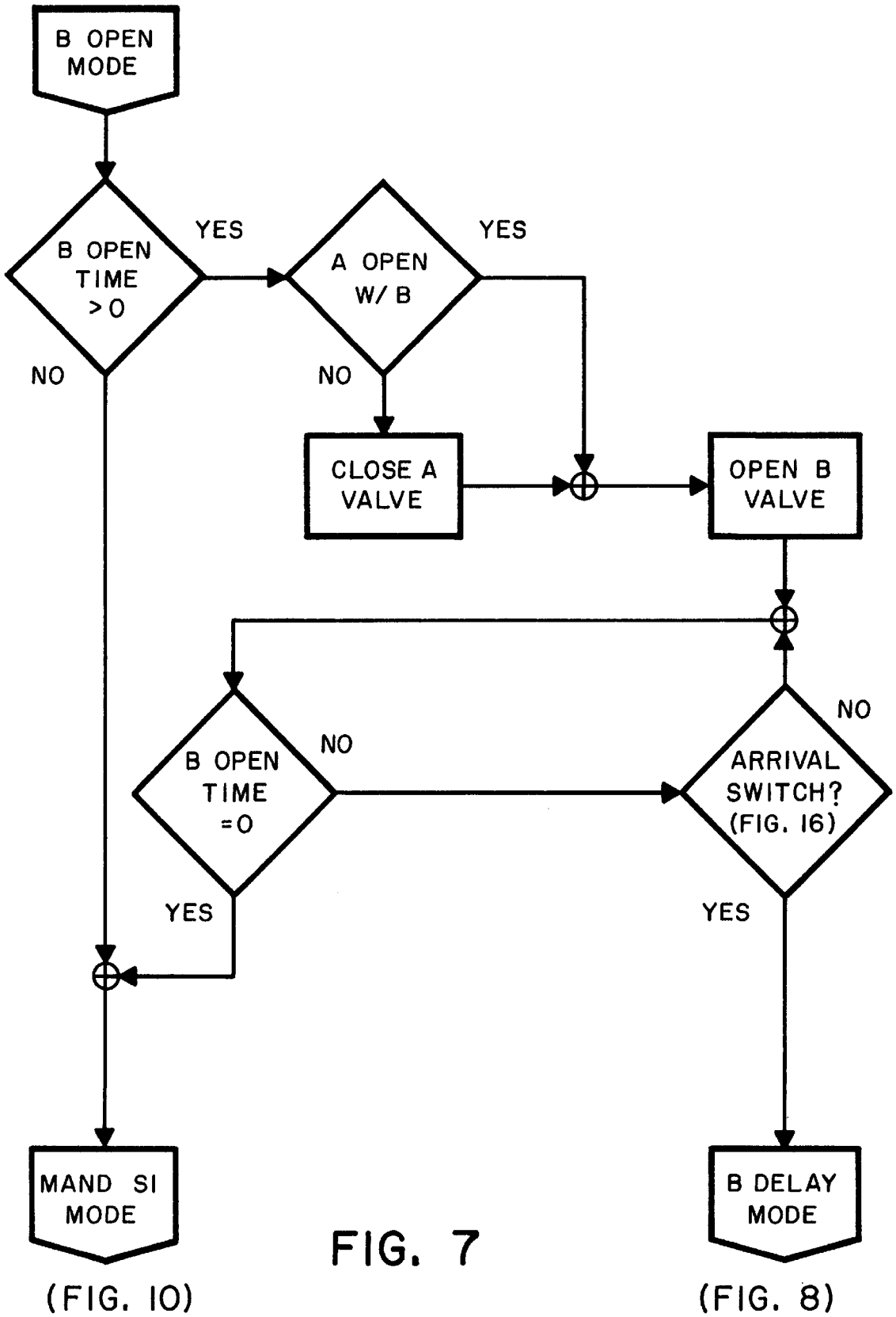

FIG. 7 depicts the B OPEN mode wherein initially the A valve 12 is closed and the B valve 14 is opened. If the plunger is sensed as being "up" before the B Open Time expires or equals zero, then the program goes to the B DELAY mode of FIG. 8. If the plunger is not sensed as being "up" when B Open Time expires or equals zero, then the program goes to the Mand SHUT-IN mode of FIG. 10.

Figure 8:
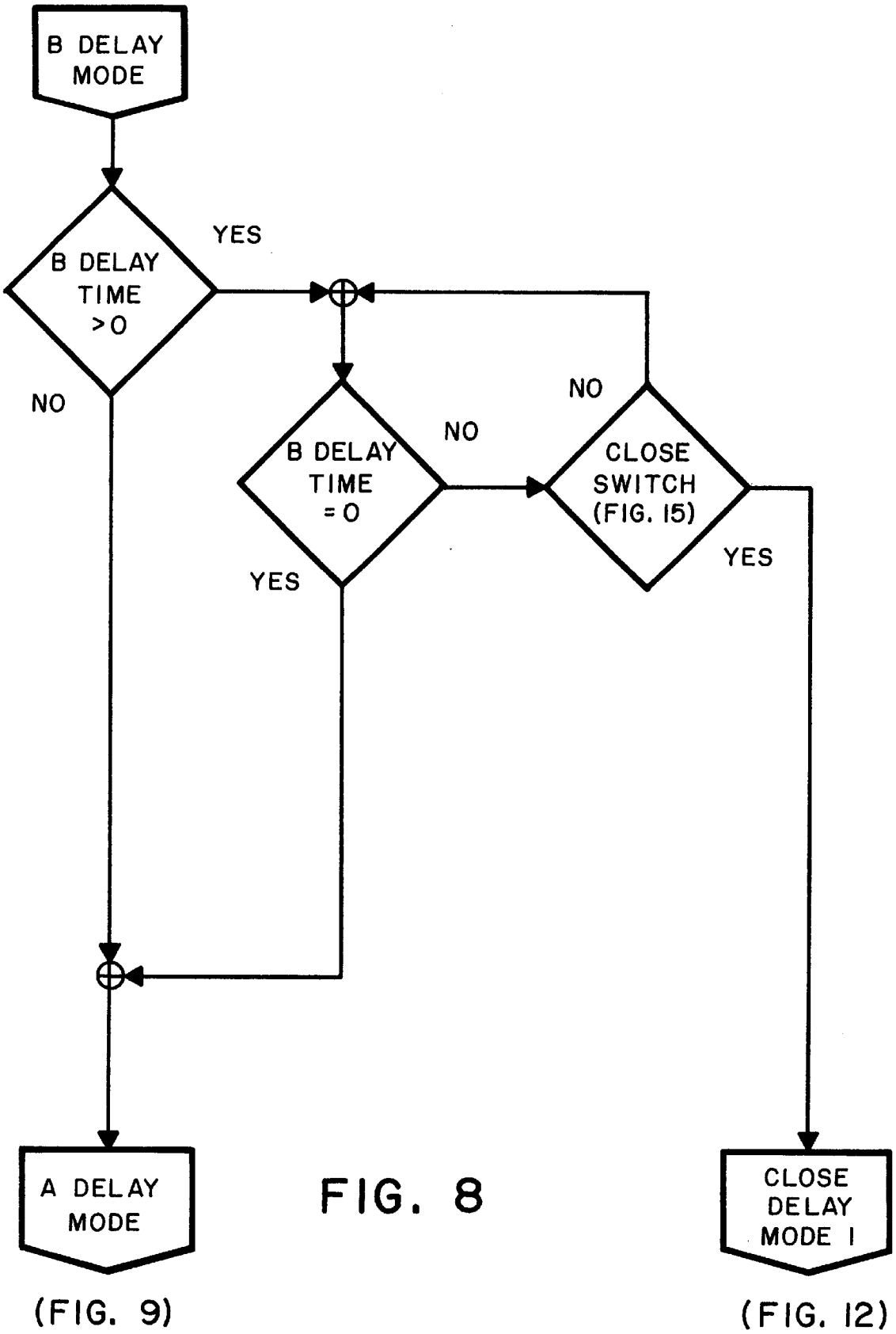

FIG. 8 depicts the B DELAY mode in which the B valve 14 is maintained open for the programmed B Delay Time. Before the B Delay time expires or equals zero, the program branches and loops through the CLOSE DELAY mode 1 of FIG. 12 before returning to the B DELAY mode of FIG. 8. Once the B Delay Time expires or equals zero, the program goes to the A DELAY mode of FIG. 9.

Figure 9:
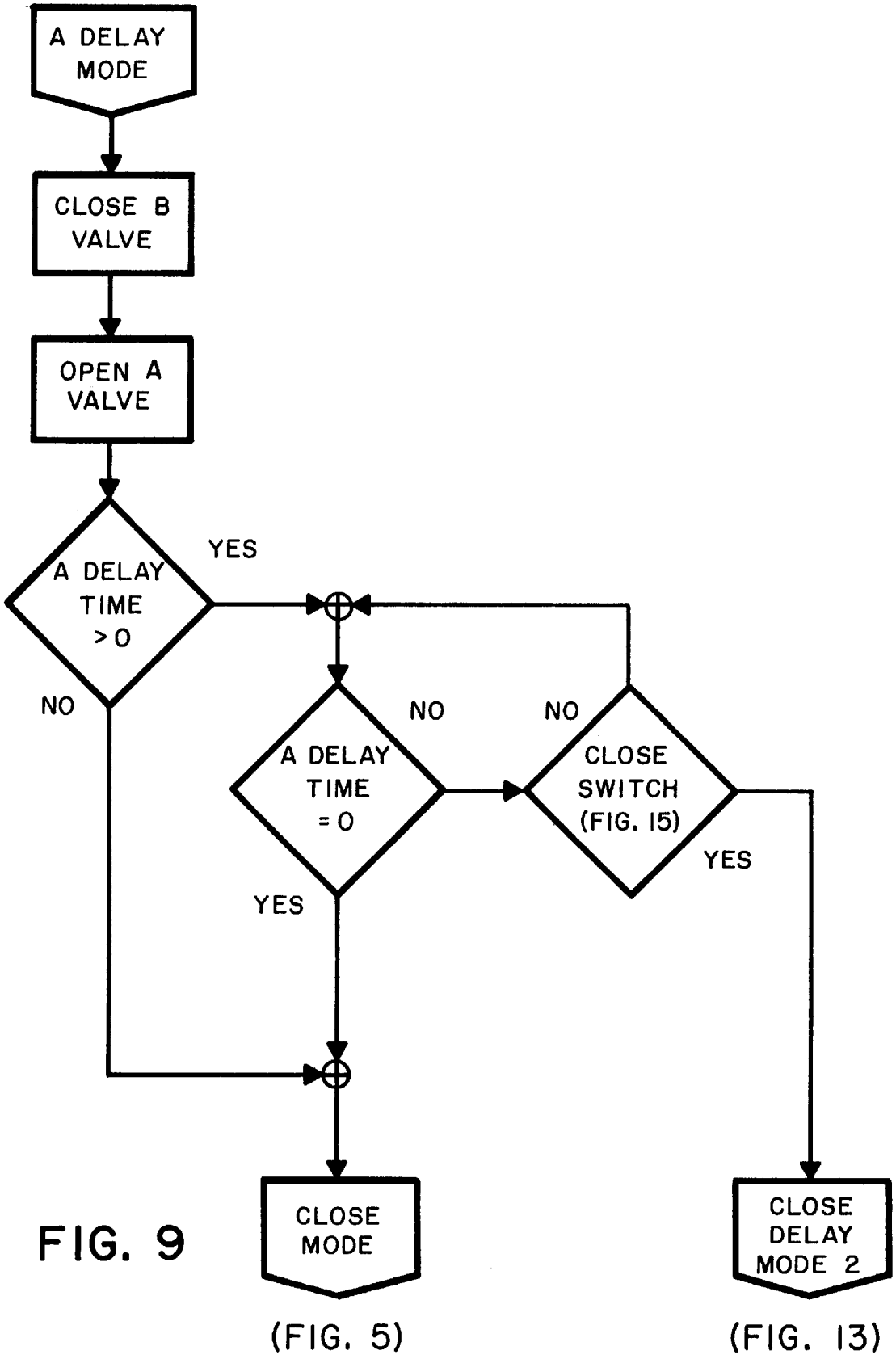

FIG. 9 depicts the A DELAY mode in which the B valve 14 is closed and the A valve 12 is maintained open and the plunger is maintained up for the programmed A Delay Time to prolong sale of gas. Before the A Delay time expires or equals zero, the program branches and loops through the CLOSE DELAY mode 2 of FIG. 13 before returning to the A DELAY mode of FIG. 9. Once the A Delay Time expires or equals zero the program returns to the CLOSE mode of FIG. 5.

Figure 10:
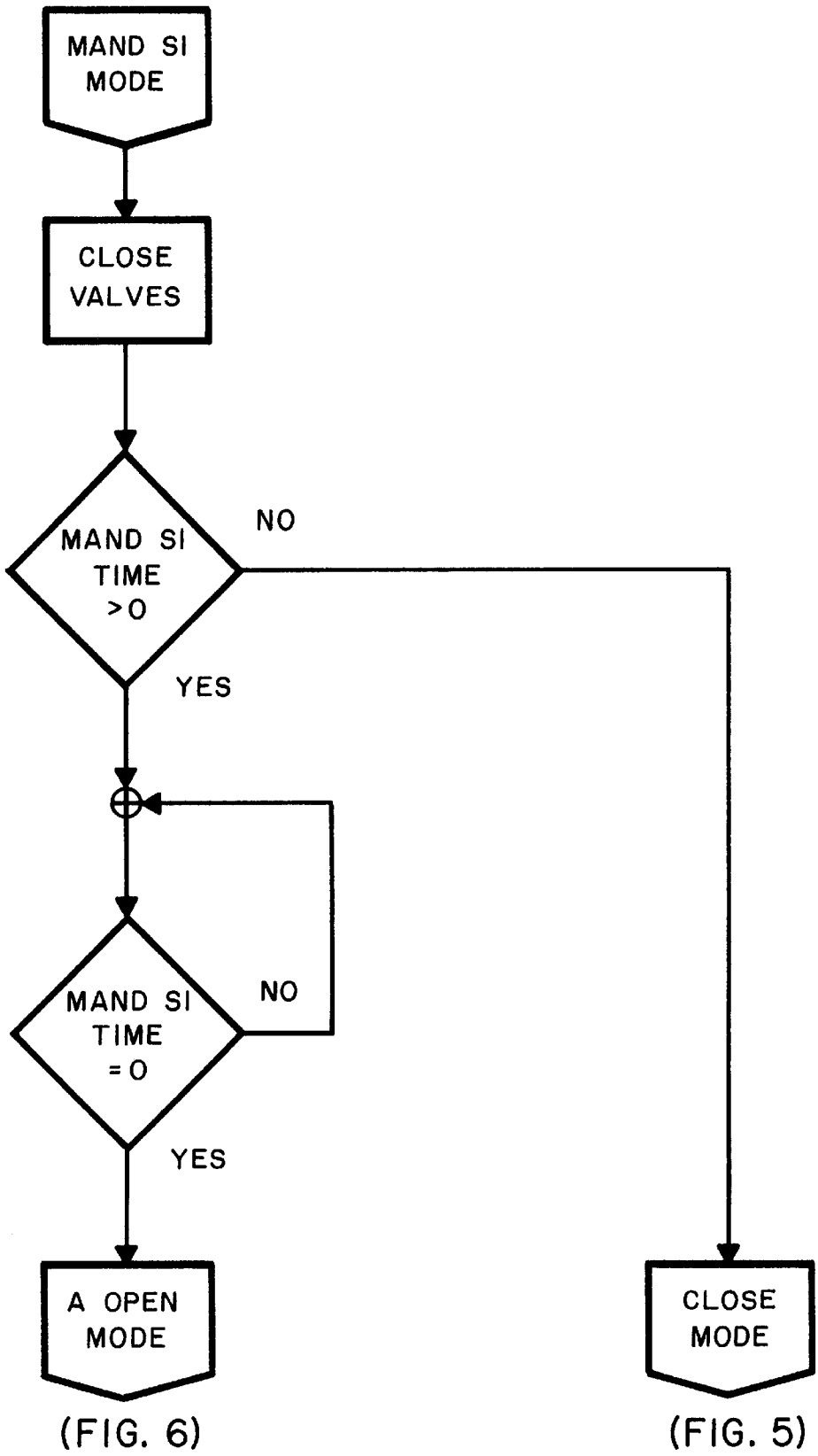

FIG. 10 depicts the MANDATORY SHUT-IN (Mand SI) mode in which both A and B valves 12, 14 are closed for a programmed mandatory shut-in time in response to the plunger not arriving at the surface within both A and B Open Times. Once the mandatory shut-in time expires or equals zero the program returns to the A OPEN mode of FIG. 6.

Figure 14:
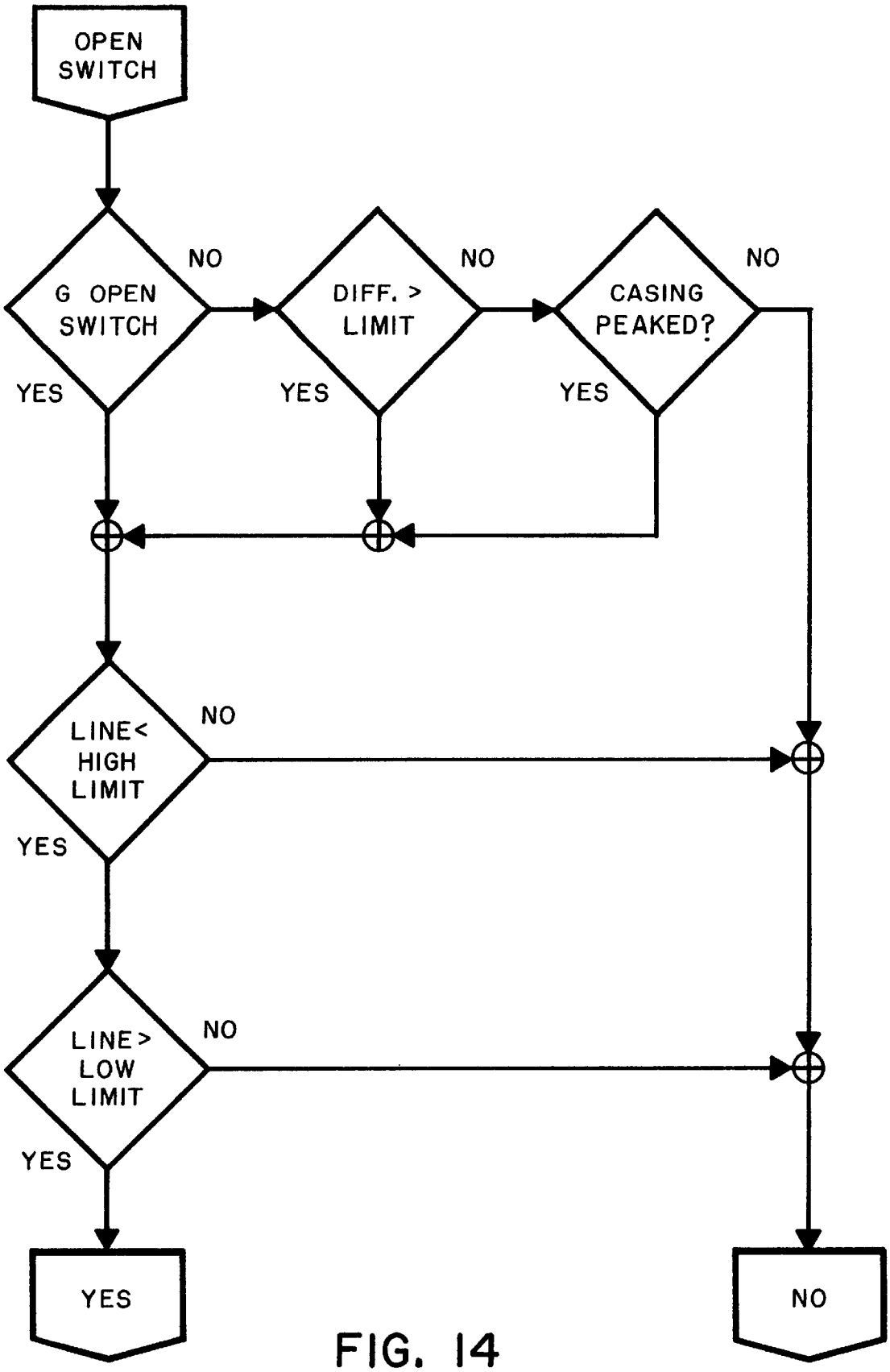

FIG. 14 depicts the OPEN SWITCH operation. The open switch input condition can become true, that is, the answer is "yes", in either one of three different ways. First, an input is received from the aux switch-gauge that is connected to the G-Open input of the micro controller 22. Second, when the differential pressure between the casing and sales line exceeds the programmed open pressure, the controller 10 treats it like an open switch input. Third, when the casing pressure has peaked and quits rising for a programmed amount of time, controller 10 treats it like an open switch input.

Figure 15:
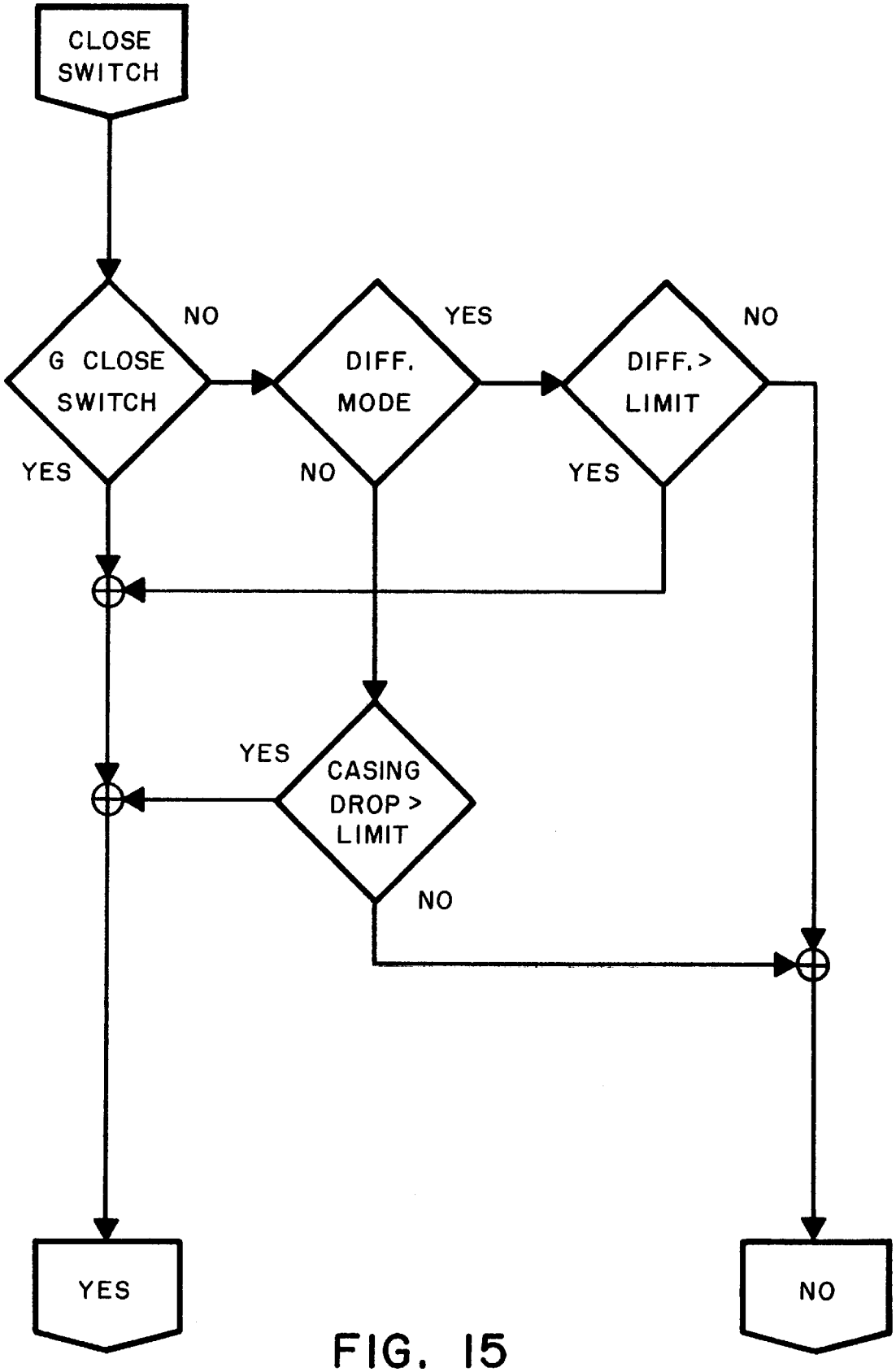

FIG. 15 depicts the CLOSE SWITCH operation. The close switch input condition can become true, that is, the answer is "yes", in either one of three different ways. First, an input is received from the aux switch-gauge that is connected to the G-Open input of the micro controller 22. Second, when the differential pressure between the casing and tubing falls below the programmed close pressure, the controller 10 treats it like a close switch input. Third, when the casing pressure has dipped to a minimum value and the pressure begins rising again, the controller 10 watches for the casing pressure to rise above the preset minimum pressure by the programmed value. The controller 10 treats it like a close switch input.

Figure 16:
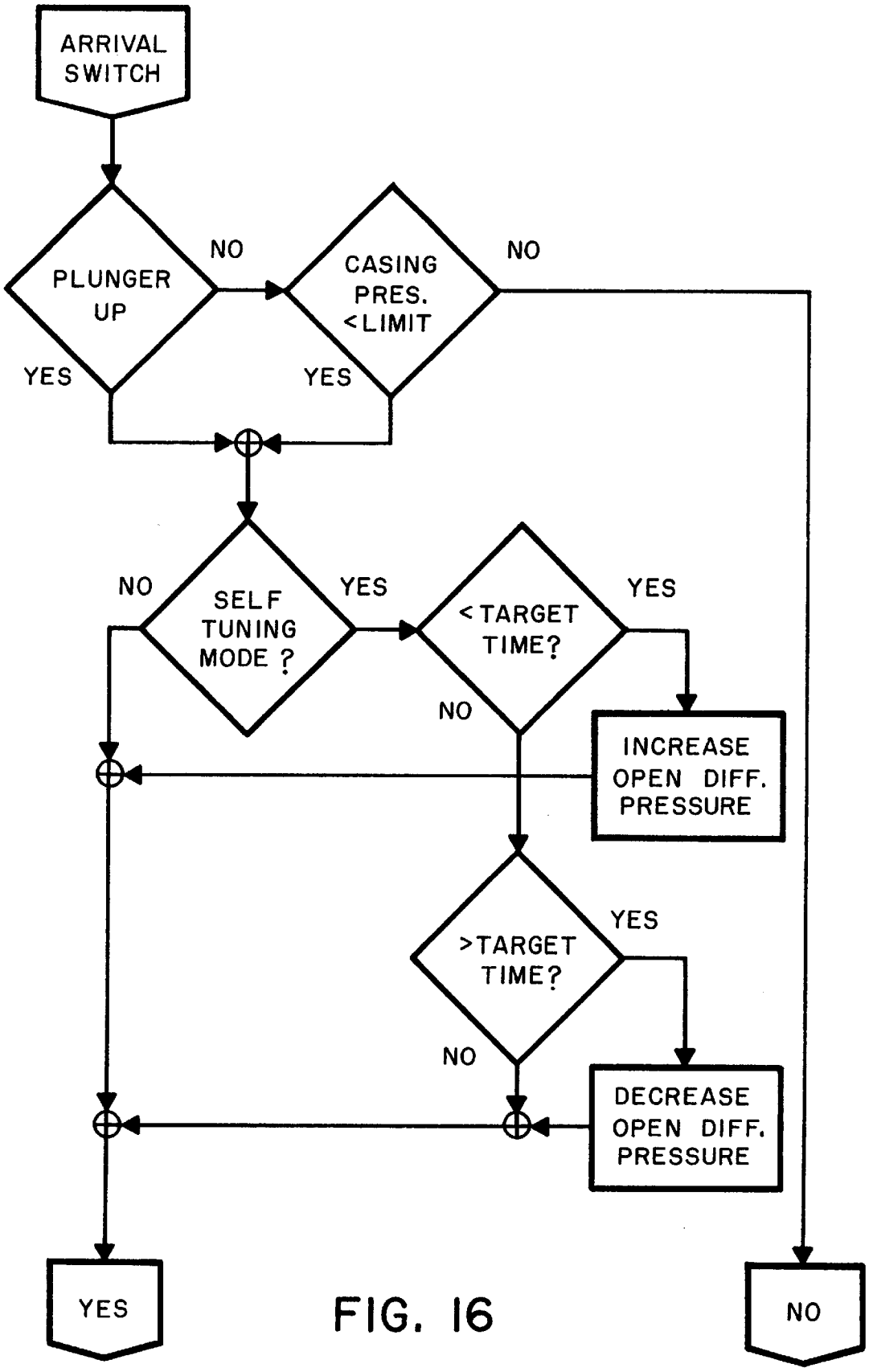

FIG. 16 depicts the ARRIVAL SWITCH operation. The arrival switch input condition can become true, that is, the answer is "yes", in either one of two different ways. First, the plunger P can come up the tubing and trip the arrival sensor S on the lubricator at the wellhead. The arrival sensor S is connected to the sensor input of the micro controller 22. Second, when the well W is first opened to flow, the controller 10 makes note of the casing pressure. If the casing pressure falls to a programmed value below this pressure during the open period, the controller 10 treats it like a sensor switch input.

Tables I and II list the various menu selections that can be made by the operator for keying instructions and values into and reading values from the controller 10. Table I lists in the first column the menu selections for displaying the current settings correspondingly listed in the second column.

TABLE I

| | |
|---|---|
| READ 00 | Display Battery Status |
| READ 01 | Display Current Status |
| READ 02 | Display A Delay Time |
| READ 03 | Display Mandatory Shut-In Time |
| READ 04 | Display A Valve & Plunger Counts |
| READ 05 | Display Open Delay Time |
| READ 06 | Display History |
| READ 07 | Display A Valve Total Open Time and Total Close Time |
| READ 08 | Display Close Delay Time |
| READ 09 | Display Sensor Status |
| READ 10 | Display Accumulated Times and Counts |
| READ 11 | Display Controller Mode |
| READ 12 | Display Open Differential Pressure |
| READ 13 | Display Close Differential Pressure |
| READ 14 | Display Sales Line Low Limit Pressure |
| READ 15 | Display Sales Line High Limit Pressure |
| READ 19 | Display Last Open and Close times |
| READ 20 | Display Casing Drop for Delay Time |
| READ ON | Display A Open Time |
| READ OFF | Display Close Time |
| READ B0 | Display Valve Mode A/B Open/Close |
| READ B2 | Display B Delay Time |
| READ B4 | Display B Valve & Plunger Counts |
| READ B7 | Display B Total Open Time |
| READ B ON | Display B Open Time |
| READ B OFF | Display Current State of Trip Count (only in Time Mode) |

Table II lists in the first column the menu selections for modifying the current settings correspondingly listed in the second column.

TABLE II

| | |
|---|---|
| SET 00 | Not Used |
| SET 01 | Not Used |
| SET 02 | Program A Delay Time |
| SET 03 | Program Mandatory Shut-In Time |
| SET 04 | Program (clear) A Valve & Plunger Counts |
| SET 05 | Program Open Delay Time |
| SET 06 | Not Used |
| SET 07 | Clear A Total Open Time |
| SET 08 | Program Close Delay Time |
| SET 09 | Enable/Disable the arrival sensor |

TABLE II-continued

| | |
|---|---|
| SET 10 | Clear Accumulated Times and Counts |
| SET 11 | Select Controller Operational Mode:<br>(1) Timed<br>(2) Differential Pressure<br>(3) Absolute Pressure<br>(4) Differential Pressure with Casing Minimum |
| SET 12 | Program Open Differential Pressure |
| SET 13 | Program Close Differential Pressure |
| SET 14 | Program Low Close Pressure for Sales Line |
| SET 15 | Program High Close Pressure for Sales Line |
| SET 16 | Set Transducer #1 Activation<br>(Casing Transducer) |
| SET 17 | Set Transducer #2 Activation<br>(Tubing Transducer) |
| SET 18 | Set Transducer #3 Activation<br>(Line Transducer) |
| SET 20 | Set Casing Drop for Delay Time |
| SET B0 | Select A Valve Mode when B Valve is Open<br>ON - A Valve Open when B Valve is Open<br>OFF - A Valve Closed when B Valve is Open |
| SET B2 | Program B Delay Time |
| SET B4 | Program (clear) B Valve & Plunger Counts |
| SET B7 | Clear B Total Open Time |
| SET B OFF | Program Trip Counter |

With respect to SET 11 involving selection of the controller operational modes, in the Timed operational mode the controller 10 uses only the programmed times and switch inputs. In the Differential Pressure operational mode, the controller 10 uses the programmed times, switch inputs, and both the programmed Close Differential Pressure value (which is the amount by which the casing pressure exceeds the tubing pressure) and the sales line pressure. In the Absolute Pressure operational mode, the controller 10 uses the programmed times, switch inputs, and the sales line pressure. In the Differential Pressure with Casing Minimum operational mode, the controller 10 uses the programmed times, switch inputs, and the programmed Open Differential Pressure value (which is the amount by which the casing pressure exceeds the sales line pressure) to open. In the DELAY program modes (FIGS. 8 and 9), the controller watches for a minimum casing pressure and goes to the CLOSE program mode (FIG. 5) when the Casing pressure has dipped and gone back up greater than the programmed Close Pressure value.

Figure 11:
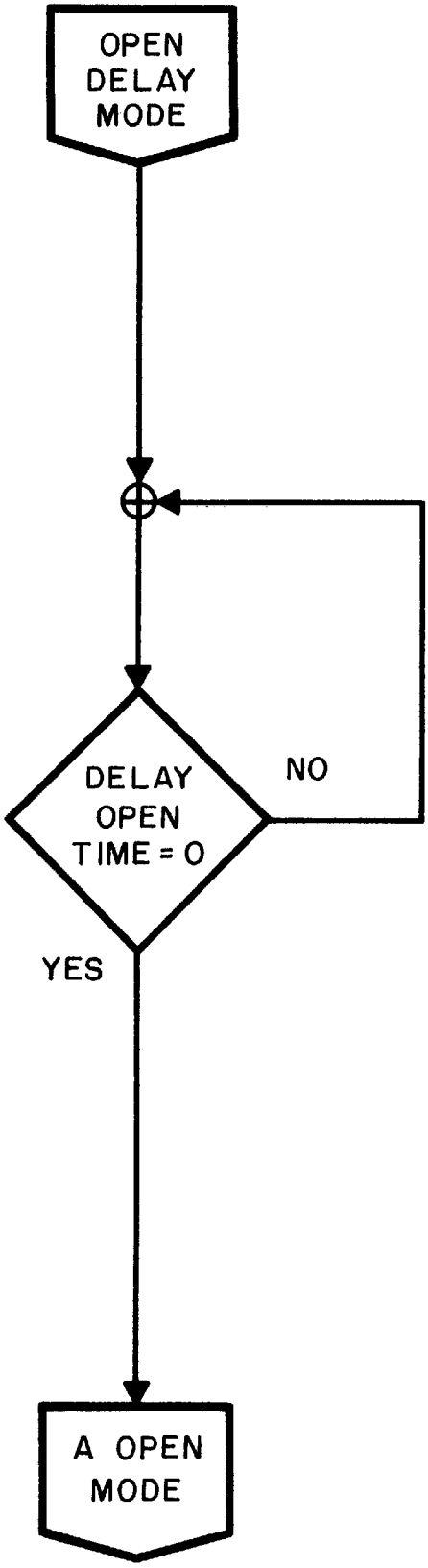

With respect to SET 12 involving programming the Open Differential Pressure value, when the sales line pressure plus the programmed Open Differential Pressure value is less than the casing pressure and the controller 10 is in the CLOSE program mode (FIG. 5), the controller 10 will check the OPEN DELAY program mode (FIG. 11). If the controller 10 has been closed longer than the programmed Open Delay Time, it will go to the A OPEN program mode (FIG. 6). If the controller 10 has been closed shorter than the programmed Open Delay Time, it will time out in the OPEN DELAY program mode (FIG. 11) before going to the A OPEN program mode (FIG. 6). The Open Delay Time should be set at some minimum that is long enough for the plunger to fall to the lower starting position in the tubing before the well opens up again. In other words, the Open Delay Time should not be set to a value less than the fall time of the plunger.

Figure 12:
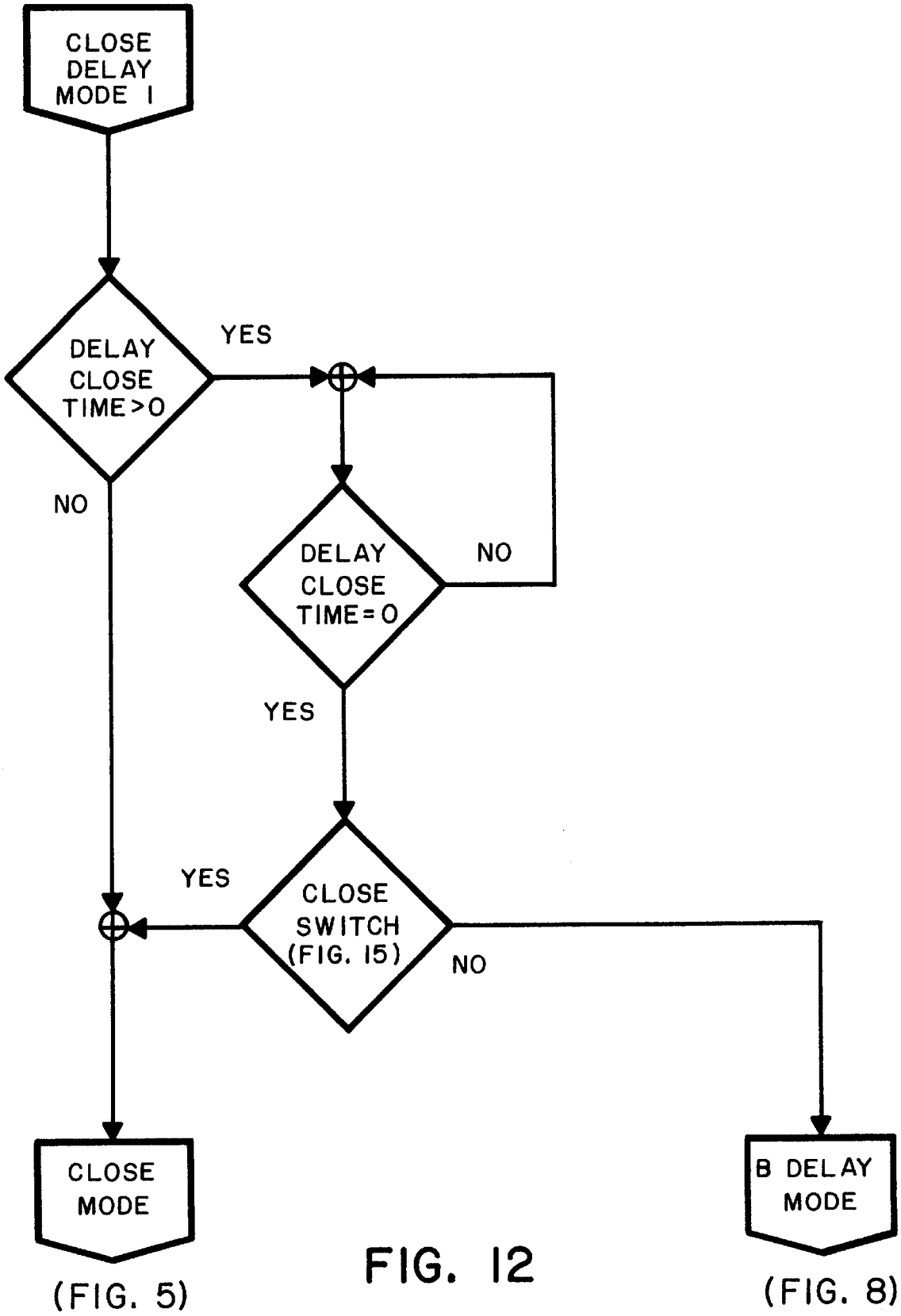
Figure 13:
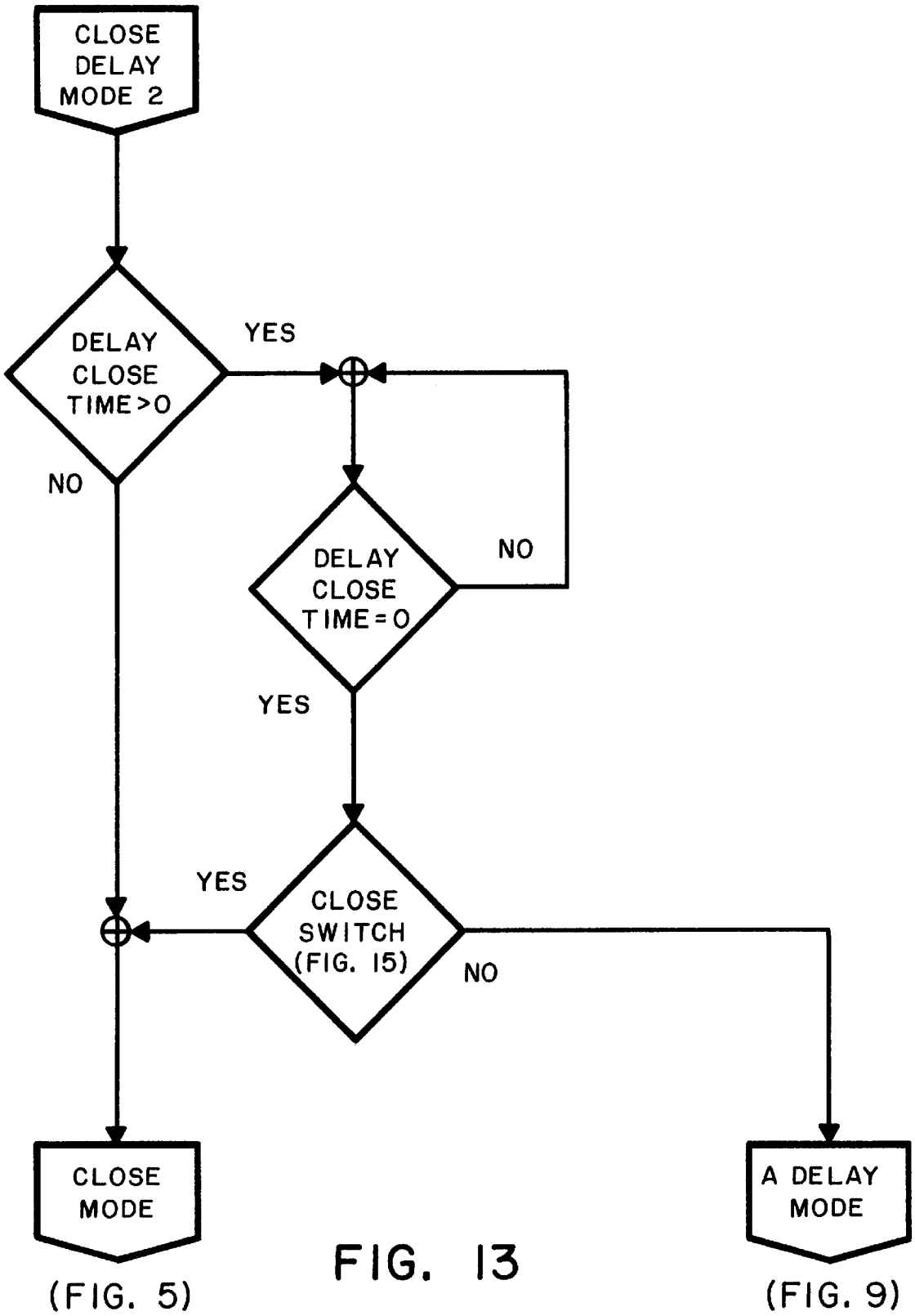

With respect to SET 13 involving programming the Close Differential Pressure value, when the casing pressure minus the tubing pressure is greater than the programmed Close Differential Pressure value and the controller 10 is in either the A DELAY or B DELAY program mode (FIGS. 8 and 9), the controller 10 will go to the CLOSE DELAY program mode (FIGS. 12 and 13). If zero time is programmed in the CLOSE DELAY program mode, the controller 10 goes to the CLOSE mode (FIG. 5). If there is a non-zero time in the CLOSE DELAY program mode, the controller 10 waits for it to time out before checking the pressure again. If the close condition is still valid, the controller 10 will go to the CLOSE program mode, otherwise it will return to either the A DELAY or B DELAY program mode and continue timing down from the point it was interrupted. The CLOSE DELAY program mode prevents spikes in the casing pressure from shutting in the well prematurely.

If the controller 10 is in the Differential Pressure with Casing Minimum operational mode and in the A DELAY or B DELAY program mode, the controller 10 will monitor the casing pressure for a programmed minimum value. When the controller 10 senses that the casing pressure has reached some selected minimum and started to rise above this minimum by the amount of the programmed Close Differential Pressure value, the controller 10 will either go to the CLOSE program mode or the CLOSE DELAY program mode as described above. The CLOSE DELAY program mode can be used to ensure the well is not shut in by pressure spikes. When the latter mode is used, the controller 10 does not need a tubing pressure transducer.

With respect to SET 14 involving programming the Low Close Pressure for Sales Line value, if the controller 10 is in any OPEN program mode and the sales line pressure falls below the programmed Low Close Pressure for Sales Line value, the controller 10 will go to the CLOSE program mode (FIG. 5). If the sales line pressure rises above the programmed Low Close Pressure for Sales Line value and is still below the programmed High Close Pressure for Sales Line value, the controller 10 will open and close as a function of the current program mode, the countdown clock, and the differential pressure.

With respect to SET 15 involving programming the High Close Pressure for Sales Line value, if the controller 10 is in any OPEN program mode and the sales line pressure rises above the programmed High Close Pressure for Sales Line value, the controller 10 will go to the CLOSE program mode (FIG. 5). If the sales line pressure falls below the programmed High Close Pressure for Sales Line value, the controller 10 will open and close as a function of the current mode, the countdown clock, and the differential pressure.

With respect to SET 16, setting activation of the casing transducer 24 is accomplished by: (1) pressing ON or OFF to activate the casing transducer 24; and (2) with the casing transducer 24 open to atmospheric pressure, pressing OFF to calibrate the low end. The display 20 will prompt the user for zero pressure. To set the high end calibration, apply a known pressure near the high rating for the casing transducer 24 and repeat step (1) from above. Then press ON in step (2). The display 20 will prompt the user for the applied pressure.

To disable the high/low control of the sales line pressure, set the low pressure to 0 psi and the high line pressure to some arbitrarily high value. The sales line pressure transducer will be disabled for high/low operation, but will still function with the casing transducer to open the well. The Open and Close switch inputs can also be used with a Murphy gauge to monitor any other pressure. A close input from any source always takes precedence over any open inputs and close in the well.

With respect to SET 17, setting activation of the tubing transducer 28 is accomplished by: (1) pressing ON or OFF to activate the tubing transducer 28; and (2) with the tubing transducer 28 open to atmospheric pressure, pressing OFF to calibrate the low end. The display 20 will prompt the user for zero pressure. To set the high end calibration, apply a known pressure near the high rating for the tubing transducer 28 and repeat step (1) from above. Then press ON in step (2). The display 20 will prompt the user for the applied pressure.

With respect to SET 18, setting activation of the sales line transducer 26 is accomplished by: (1) pressing ON or OFF to activate the sales line transducer 26; and (2) with the sales line transducer 26 open to atmospheric pressure, pressing OFF to calibrate the low end. The display 20 will prompt the user for zero pressure. To set the high end calibration, apply a known pressure near the high rating for the sales line transducer 26 and repeat step (1) from above. Then press ON in step (2). The display 20 will prompt the user for the applied pressure.

With respect to the Open Differential Pressure the controller 10 always monitors the casing/tubing differential pressure. With respect to the Close Differential Pressure the controller 10 always monitors the casing/tubing differential pressure. The programmed times will continue to count down to zero and switch the controller 10 to the next appropriate mode if the differential pressures do not change enough to cause the mode switch.

The controller 10 only monitors for a casing pressure minimum for a casing-tubing pressure differential when the controller 10 is in the DELAY program mode. On wells running without a plunger, the previous solution to this limitation was to place a short across the sensor input so that the controller 10 went straight from the CLOSE program mode to the DELAY program mode. On flowing wells that need to be vented, this option will allow B valve operation when the casing pressure hasn't dropped by the programmed limit by the end of the A Open Time.

When the controller 10 begins the A OPEN program mode, the casing pressure is read. The controller 10 then monitors the casing pressure for a drop equal to or greater than the programmed minimum value. When this drop is observed in either the A OPEN OR B OPEN program mode, it is treated the same as a plunger arrival and sends the controller 10 to either the A DELAY or B DELAY program mode. This arrival will be listed in the travel time histories stored in the controller memory as a plunger arrival. If the programmed Casing Drop for Delay Time value is set to 0 psi, the controller 10 will not monitor the casing pressure for occurrence of the aforementioned drop.

To recapitulate, the major improvement fostered by the present invention is a more accurate way to determine when to close the A valve and terminate gas sales so that gas sales are allowed to continue for as long as possible with each trip of the plunger. Due to approach of the present invention once gas sales are occurring they will be allowed to continue as long as the casing pressure is dropping and until the casing pressure reverses and starts to rise. When the casing pressure rises by a chosen minimum pressure, such as one to two pounds, the A valve will be closed. This minimum pressure used to determine when to close the A valve is termed the Close Pressure. The casing pressure-sensing transducer connected to the controller senses when the current pressure of the casing reaches a minimum, reverses and starts to rise. The controller will close the A valve terminating gas sales when the rise in casing pressure exceeds the programmed Close Pressure. This approach of the present invention delays closing the A valve so that gas sales will continue as long as the casing pressure has not decreased to the minimum pressure which is the level when the casing pressure reverses and starts to rise again.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A casing differential pressure based control method used in conjunction with a gas-producing well, a casing within the well for receiving a flow of gas under pressure from a production formation, a tubing extending downward within the casing to a lower portion being in communication with the casing for receiving the flow of gas under pressure therefrom, a sales line located outside of the well and connected in flow communication with the tubing for routing the flow of gas under pressure away from the well, an A valve interposed in the sales line and being convertable between open and close states in which flow of gas is correspondingly allowed and blocked from the tubing to the sales line, and an electronic controller connected to the A valve for controlling the cycling of the A valve between open and close states and thereby the well between the open and shut-in conditions in which the gas under pressure flows correspondingly from the tubing and elevates in pressure in the casing, said method comprising the steps of:

(a) sensing the current casing pressure, current tubing pressure and current sales line pressures;

(b) switching the A valve to open state such that gas sales are initiated in response to sensing when the current casing pressure exceeds the current sales line pressure; and (c) switching the A valve to close state such that gas sales are terminated in response to sensing when the current casing pressure has decreased, reversed and then risen by a preset minimum pressure.

2. The method of claim 1, further comprising:

presetting an Open Differential Pressure equal to a preset minimum pressure difference by which the casing pressure exceeds the sales line pressure.

3. The method of claim 2, further comprising:

calculating the difference between the current casing pressure and current sales line pressure, said switching of the A valve to open state being in response to sensing when the difference between the current casing pressure and current sales line pressure reaches the preset Open Differential Pressure.

4. The method of claim 1, further comprising:

presetting a Close Pressure equal to said preset minimum pressure of the casing.

5. The method of claim 4, further comprising:

sensing the current casing pressure, said switching of the A valve to close state being in response to sensing when the current casing pressure has decreased, reversed and then risen by the preset Close Pressure.

6. A casing differential pressure based control method used in conjunction with a gas-producing well, a casing within the well for receiving a flow of gas under pressure from a production formation, a tubing extending downward within the casing to a lower portion being in communication with the casing for receiving the flow of gas under pressure therefrom, a sales line located outside of the well and connected in flow communication with the tubing for routing the flow of gas under pressure away from the well, an A valve interposed in the sales line and being convertable between open and close states in which flow of gas is correspondingly allowed and blocked from the tubing to the sales line, and an electronic controller connected to the A valve for controlling the cycling of the A valve between open and close states and thereby the well between the open and shut-in conditions in which the gas under pressure flows correspondingly from the tubing and elevates in pressure in the casing, said method comprising the steps of:

(a) presetting an open Differential Pressure equal to a preselected minimum pressure difference by which the casing pressure exceeds the sales line pressure;

(b) presetting a Close Pressure equal to a preselected minimum pressure of the casing;

(c) sensing the current casing pressure and current sales line pressure and calculating the difference between current casing pressure and current sales line pressure;

(d) comparing the difference between the current casing pressure and current sales line pressure to the Open Differential Pressure;

(e) comparing the current casing pressure to the Close Pressure;

(f) in response to sensing when the difference between the current casing pressure and current sales pressure equals the Open Differential Pressure, switching the A valve to the open state such that gas sales are initiated; and (g) after switching of the A valve to the open state and in response to sensing when the current casing pressure has decreased, reversed and then risen by the Close Pressure, switching the A valve to the close state terminating gas sales such that gas sales thereby are allowed to continue as long as the current casing pressure is dropping and until the casing pressure reverses and then rises by the Close Pressure.

7. A casing differential pressure based control method used in conjunction with a gas-producing well, a casing within the well for receiving a flow of gas under pressure from a production formation, a tubing extending downward within the casing to a lower portion being in communication with the casing for receiving the flow of gas under pressure therefrom, a freely movable plunger disposed in the tubing for traveling vertically relative to the tubing between a lower initial position and an upper terminal position in response to open and shut-in conditions of the casing, a sales line located outside of the well and connected in flow communication with the tubing for routing the flow of gas under pressure away from the well, an A valve interposed in the sales line and being convertable between open and close states in which flow of gas is correspondingly allowed and blocked from the tubing to the sales line, and an electronic controller connected to the A valve for controlling the cycling of the A valve between open and close states and thereby the well between the open and shut-in conditions in which the plunger travels correspondingly upward to the upper terminal position and downward to the lower initial position and the gas under pressure flows correspondingly from the tubing and elevate in pressure in the casing, said method comprising the steps of:

(a) sensing the current casing pressure, current tubing pressure and current sales line pressures;

(b) switching the A valve to open state such that gas sales are initiated in response to sensing when the current casing pressure exceeds the current sales line pressure;

(c) sensing the arrival of the plunger at the upper terminal position; and (d) after sensing the arrival of the plunger at the upper terminal position, switching the A valve to close state such that gas sales are terminated in response to sensing when the current casing pressure has decreased, reversed and then risen by a preset minimum pressure.

8. The method of claim 7, further comprising:

presetting an Open Differential Pressure equal to a preset minimum pressure difference by which the casing pressure exceeds the sales line pressure.

9. The method of claim 8, further comprising:

calculating the difference between the current casing pressure and current sales line pressure, said switching of the A valve to open state being in response to sensing when the difference between the current casing pressure and current sales line pressure reaches the preset Open Differential Pressure.

10. The method of claim 7, further comprising:

presetting a Close Pressure equal to a preset minimum pressure of the casing.

11. The method of claim 10, further comprising:

said switching of the A valve to close state being in response to sensing when the current casing pressure has decreased, reversed and then risen by the preset Close Pressure.

12. A casing differential pressure based control method used in conjunction with a gas-producing well, a casing within the well for receiving a flow of gas under pressure from a production formation, a tubing extending downward within the casing to a lower portion being in communication with the casing for receiving the flow of gas under pressure therefrom, a freely movable plunger disposed in the tubing for traveling vertically relative to the tubing between a lower initial position and an upper terminal position in response to open and shut-in conditions of the casing, a sales line located outside of the well and connected in flow communication with the tubing for routing the flow of gas under pressure away from the well, an A valve interposed in the sales line and being convertable between open and close states in which flow of gas is correspondingly allowed and blocked from the tubing to the sales line, and an electronic controller connected to the A valve for controlling the cycling of the A valve between open and close states and thereby the well between the open and shut-in conditions in which the plunger travels correspondingly upward to the upper terminal position and downward to the lower initial position and the gas under pressure flows correspondingly from the tubing and elevate in pressure in the casing, said method comprising the steps of:

(a) presetting an Open Differential Pressure equal to a preselected minimum pressure difference by which the casing pressure exceeds the sales line pressure;

(b) presetting a Close Pressure equal to a preselected minimum pressure of the casing;

(c) sensing the current casing pressure and current sales line pressure and calculating the difference between current casing pressure and current sales line pressure;

(d) comparing the difference between the current casing pressure and current sales line pressure to the Open Differential Pressure;

(e) sensing the arrival of the plunger at the upper terminal position;

(f) in response to sensing when the difference between the current casing pressure and current sales line pressure equals the Open Differential Pressure, switching the A valve to the open state such that gas sales are initiated; and (g) after switching of the A valve to the open state and in response to sensing the arrival of the plunger at the upper terminal position and the rising of current casing pressure by the Close Pressure, switching the A valve to the close state terminating the gas sales such that gas sales thereby are allowed to continue as long as the current casing pressure is dropping and until the casing pressure reverses and then rises by the Close Pressure.

* * * * *